US011193644B2

(12) United States Patent
Krick et al.

(10) Patent No.: US 11,193,644 B2
(45) Date of Patent: Dec. 7, 2021

(54) REFLECTOR DEVICE FOR A LIGHT MODULE WITH ELECTROMAGNETIC SHIELDING

(71) Applicant: VALEO VISION, Bobigny (FR)

(72) Inventors: Sebastian Krick, Paris (FR); Mohamed Jaaidane, Les Mureaux (FR); Hamza Bouayad, Bobigny (FR); David Boudikian, Paris (FR); Florestan Debert, Nomain (FR); Franck Dinant, Virginal (BE)

(73) Assignee: VALEO VISION, Bobigny (FR)

( * ) Notice: Subject to any disclaimer, the term of this patent is extended or adjusted under 35 U.S.C. 154(b) by 261 days.

(21) Appl. No.: 15/548,800

(22) PCT Filed: Feb. 4, 2016

(86) PCT No.: PCT/EP2016/052334
§ 371 (c)(1),
(2) Date: Aug. 4, 2017

(87) PCT Pub. No.: WO2016/124664
PCT Pub. Date: Aug. 11, 2016

(65) Prior Publication Data

US 2018/0031198 A1 Feb. 1, 2018

(30) Foreign Application Priority Data

Feb. 6, 2015 (FR) ..... 1550971

(51) Int. Cl.
*F21S 41/37* (2018.01)
*F21S 41/19* (2018.01)
(Continued)

(52) U.S. Cl.
CPC ..... *F21S 41/37* (2018.01); *F21S 41/148* (2018.01); *F21S 41/192* (2018.01);
(Continued)

(58) Field of Classification Search
CPC ..... F21S 41/147; F21S 41/148; F21S 41/19; F21S 41/192; F21S 41/194; F21S 41/196;
(Continued)

(56) References Cited

U.S. PATENT DOCUMENTS 6,066,921 A * 5/2000 Nakamura ..... B60Q 1/0094 315/71
6,072,277 A * 6/2000 Yamamoto ..... B60Q 1/0088 315/82

(Continued)

FOREIGN PATENT DOCUMENTS

CN 2452818 10/2001
CN 1906733 1/2007

(Continued)

OTHER PUBLICATIONS

Machine translation of DE 102009023268 A1 retrieved from Espacenet. (Year: 2020).*

(Continued)

*Primary Examiner* — Alexander K Garlen
*Assistant Examiner* — Colin J Cattanach
(74) *Attorney, Agent, or Firm* — ObLon, McClelland, Maier & Neustadt, L.L.P.

(57) ABSTRACT

The subject of the invention is a reflector device for a lighting module of a motor vehicle. The device includes a housing made of plastic, wherein the internal faces are metallized so as to reflect the light received. The housing on an external face of one of its walls has reception means able to house a support including at least one light source, the wall having an opening which leads toward the inside of the housing and which allows the light emitted by the light source or sources to propagate toward the inside of the housing. According to the provisions of the invention, the external face of the housing may be connected to ground (Continued)

potential so as to act as a shield against the electromagnetic waves emitted by various electronic components.

18 Claims, 3 Drawing Sheets

(51) Int. Cl.

| | |
|---|---|
| ***F21S 45/00*** | (2018.01) |
| ***F21S 41/148*** | (2018.01) |
| ***H05B 45/00*** | (2020.01) |
| ***F21S 41/275*** | (2018.01) |
| ***F21S 43/14*** | (2018.01) |
| ***F21V 15/01*** | (2006.01) |
| ***F21S 45/48*** | (2018.01) |
| ***F21S 41/147*** | (2018.01) |
| ***F21Y 115/10*** | (2016.01) |
| ***F21S 43/20*** | (2018.01) |

(52) U.S. Cl.
CPC ..... *F21S 41/275* (2018.01); *F21S 43/14* (2018.01); *F21S 45/00* (2018.01); *F21V 15/01* (2013.01); *H05B 45/00* (2020.01); *F21S 41/147* (2018.01); *F21S 43/20* (2018.01); *F21S 45/48* (2018.01); *F21Y 2115/10* (2016.08)

(58) Field of Classification Search
CPC ..... F21S 41/198; F21S 43/30; F21S 43/31; F21S 43/315; F21S 43/33; F21S 43/37
See application file for complete search history.

(56) References Cited

U.S. PATENT DOCUMENTS 6,458,428 B2 * 10/2002 Inaba ..... C23C 14/205 427/491
6,967,288 B2 * 11/2005 Ohsawa ..... B60Q 1/0088 174/104
8,760,070 B2 * 6/2014 Flandre ..... H05B 39/047 315/247
9,702,528 B2 * 7/2017 Dinant ..... F21K 9/20
2001/0026836 A1 10/2001 Inaba
2005/0225985 A1 * 10/2005 Catalano ..... F21V 7/06 362/277
2009/0225563 A1 * 9/2009 Yamamoto ..... F21S 41/17 362/519
2010/0149830 A1 * 6/2010 Kawamura ..... F21S 41/17 362/538
2010/0321947 A1 * 12/2010 Hamashima ..... F21S 41/192 362/517
2011/0038172 A1 2/2011 Vollmer et al.
2011/0058387 A1 * 3/2011 Matsunaga ..... F21K 9/00 362/547
2012/0020104 A1 * 1/2012 Biebl ..... F21K 9/00 362/546
2013/0039085 A1 * 2/2013 Iwasaki ..... F21S 41/147 362/516
2013/0329443 A1 * 12/2013 Yasuda ..... F21S 41/147 362/516
2014/0036525 A1 * 2/2014 Woodward ..... F21S 41/19 362/516
2015/0036354 A1 * 2/2015 Adams ..... F21V 7/0083 362/311.02
2015/0062948 A1 * 3/2015 Otsubo ..... F21S 41/148 362/518
2015/0211725 A1 * 7/2015 Ikuta ..... F21S 41/192 362/382
2015/0224915 A1 * 8/2015 Sazuka ..... F21S 45/43 362/516
2015/0325740 A1 * 11/2015 Serita ..... F21S 41/192 257/98
2016/0084475 A1 * 3/2016 Fujii ..... F21V 7/04 362/294

FOREIGN PATENT DOCUMENTS

DE 10 2007 037 822 A1 2/2009
DE 102009023268 A1 * 6/2010 ..... F21V 19/0035
DE 10 2009 016 876 A1 10/2010
EP 1 070 971 A1 1/2001
EP 2 045 514 A1 4/2009
GB 2079434 6/1984
GB 2 360 775 A 10/2001
WO WO-2010119580 A1 * 10/2010 ..... F21V 17/12

OTHER PUBLICATIONS

International Search Report dated Mar. 16, 2016 in PCT/EP2016/052334 filed Feb. 4, 2016.
French Search Report dated Dec. 9, 2015 in FR 1550971 filed Feb. 6, 2015.
Indian Hearing Notice issued Oct. 23, 2020 in Indian Application No. 201717026371.
Indian Examination Report dated Aug. 14, 2019 in Indian Application No. 201717026371.

* cited by examiner

REFLECTOR DEVICE FOR A LIGHT MODULE WITH ELECTROMAGNETIC SHIELDING

The present invention relates to a reflector and relates more particularly to the application of such a device to a lighting module comprising at least one light emitting diode the light emitted by which is reflected off the internal faces of the reflector. The arrangements of the reflector make it possible to lessen the effects of the electromagnetic waves emitted by the diode or diodes or the circuit that powers them.

It has become commonplace to use light emitting diode lighting modules to emit rays of light in order to perform a lighting and/or signaling function for a motor vehicle. The use of these diodes notably allows the ray of light emitted to be focused and makes it possible, in a small space, associated with beam-bending means, easily to direct in a desired direction the ray of light leaving the lighting module.

Thermal cooling means are conventionally associated with this type of lighting module equipped with light emitting diodes, LEDs, because these diodes are generally supported by a printed circuit board that also supports electronic components for powering and controlling the diode. An LED power supply control circuit generally comprises a DC/DC converter capable of converting an input voltage, supplied by a source of current of the vehicle such as the battery, into a charge voltage able to operate the LEDs. The LEDs need to be cooled in order to ensure discrete and correct operation and durability over time.

Some of these electronic components, for example a DC/DC converter and, to a lesser extent, also the light emitting diodes powered, generate electromagnetic disturbances and it is appropriate to prevent these from spreading outside the module so as to prevent them from interfering with other electronic equipment present in the vehicle.

To do that, the use of a metal cage, acting as a Faraday cage, and that is positioned so that it covers the printed circuit board, is known. These metal cages may be expensive and have a design that is fixed by the manufacturers of these cages, something which may impact on the design and layout of the electronic components on the printed circuit board.

The present invention falls within this context and its objective is to propose means capable of lessening the electromagnetic disturbances which do not have the aforementioned disadvantages and which are particularly simple to implement and easy to adapt to various configurations of module.

The subject of the invention is a reflector device for a lighting module of a motor vehicle. The device comprises a housing made of plastic, at least part of the internal faces of which is metallized so as to reflect the light received. The housing on an external face of one of its walls comprises reception means able to house a support comprising at least one light source. Said wall comprises an opening which leads toward the inside of the housing, and which allows the light emitted by the light source or sources to propagate toward the inside of the housing. The device is notable in that at least part of the reception means on the external face of the housing is metallized so as to define a contact zone that allows the metallized part to make electrical contact.

For preference, the metallized part of the internal faces of the housing may be arranged in such a way that the light emitted by the light source or sources and reflected off this metallized part forms a beam of light that performs a predetermined photometric function, for example acts as a fog light.

For preference, the reception means may comprise a cavity in the external face of said wall of the housing, the bottom of the cavity comprising said opening.

For preference, the reception means may comprise one or more indexing studs to align the support comprising the light sources with respect to the housing of the reflector, so that the LEDs are oriented in such a way that their emitted light can propagate through the opening toward the inside of the housing, where it is reflected.

All the external faces of the housing may preferably be metallized.

For preference, the metallization of the external face may comprise a layer of aluminum.

Another subject of the invention is a lighting module for the lighting and/or signaling of a motor vehicle. The lighting module comprises at least one light source powered by an electric supply control circuit and arranged on a support, and a reflector device. The lighting module is notable in that the reflector device is in accordance with the invention. The reception means of the housing are able to house said support in such a way as to allow the light emitted by the light sources to propagate through said opening, and the contact zone is connected to ground.

Advantageously, the housing of the reflector device forms the housing of the lighting module. In other words, said at least one metaled part of the internal faces of the housing of the module forms a reflector.

If appropriate, the module may comprise a transparent closure outer lens intended to allow light reflected by the reflector device to pass, the housing comprising a front opening closed by said closure outer lens.

The support may preferably comprise a plate which on its periphery has notches able to collaborate with the indexing studs formed on the housing. The plate may preferably also at its center have bores able to collaborate with indexing posts formed this time on the internal face of a cover able to cover the support. The plate may furthermore comprise slots formed regularly near a front longitudinal edge and able to collaborate with tabs borne by an element for lateral closure of the support.

The support may advantageously be a printed board ("printed circuit board" PCB), the light sources being arranged on a first face of the board which faces toward the external face of the wall of the housing of the reflector device.

Alternatively, the support may be a flexible printed board ("flexible printed circuit board" FPCB).

The printed board may preferably comprise, on its second face, at least one electronic component for controlling and supplying the light sources.

For preference, the first face of the printed board may comprise an electrically conducting spring one end of which is soldered to the support and connected to ground. The second end of the spring comes into contact with the contact zone of the housing when the board is housed in the reception means.

The module may advantageously comprise a heat sink arranged in such a way as to allow the removal of the heat produced by the light sources or by the electrical power control circuit.

Light sources may preferably be arranged on the heat sink. In this case, the power supply and control circuit may advantageously be connected to the light sources by "wire-bonded" electrical connections, the circuit in question being situated remotely with respect to the location of the light sources. Advantageously, the remote circuit may also be arranged on the heat sink.

The contact zone of the housing may preferably be electrically connected to the heat sink, which is connected to ground. If appropriate, the heat sink is made from an electrically conducting material, for example a metallic material.

For preference, the contact zone of the housing may be electrically connected to an element of the control circuit, which is connected to ground.

The light sources may advantageously be light emitting diodes LEDs or alternatively, laser diodes.

The module may preferably also comprise a cover able to cover the support which is housed in the reception means of the housing. The housing comprises a cavity on its internal face. The cavity on the internal face may preferably comprise two zones separated substantially transversely by confinement walls. A first zone may be delimited by these walls and by a circular rim and a second zone, forming the confinement zone, may preferably be delimited by these walls and by a rim formed by straight-line segments.

The internal face of the cover may preferably comprise, within these walls defining the housing space, a central barrel, with a channel around the periphery so as to prevent thermal paste from overspilling when the printed circuit board is mounted on the cover. Specifically, a thermal paste may preferably be placed on the top of the barrel so that it can come into contact with the printed circuit board upon mounting to facilitate the transmission of the heat emitted by the diode to the cover and the means of thermal cooling thereof.

For preference, the internal face of the cover may also bear two indexing posts arranged longitudinally on each side of the central barrel, and indexing means that complement those formed on the housing to grip the printed circuit board.

For preference, the lateral walls of the cover, unlike the transverse wall, do not have a planar surface at their free end but have a low wall arranged on the opposite side to the confinement zone forming an end stop for the placement of the printed circuit board on the lateral walls.

The lateral walls may preferably be truncated at the end of a chicane so that they do not meet one another and so that an opening is thus left at a front longitudinal end of the confinement zone, between the lateral walls, at the rim formed by straight-line segments. A front and rear longitudinal end are defined according to the installation in the motor vehicle.

For preference, the module also comprises an element for laterally closing the support, which is able to collaborate with slots formed on an edge of said plate of the support. The closure element may preferably be produced from a piece of sheet metal, advantageously made of stainless steel. The height of the closure element, which means to say the distance between the first edge bearing the fixing means and the flat second edge, is slightly less than the distance between the printed circuit board support plane and the bottom of the housing space in the region of the channel. In that way, an air passage is left between the closed end of the housing space and the attached element that acts as a closure piece closing the opening of the confinement space.

The closure element may preferably also comprise bosses formed so that they project from the plane of the component near one edge. These bosses are intended to ensure the grounding of the component, which grounding is supposed to stop the electromagnetic waves generated in the confinement zone, on the cover.

By using the measures proposed by the invention, the reflector element of a lighting module, which is already present in embodiments known from the prior art, also becomes a shielding element shielding against the electromagnetic waves emitted either by the electronic components that form the power supply circuit for the light sources of the module or by the sources themselves. The embodiment is particularly advantageous because it can, in a preferred embodiment, confine itself to the addition of a metallized contact zone on the rear face of the reflector, the rear face being the face that has no optical activity of reflecting light during normal operation thereof. This contact zone can be connected to ground when the lighting module is being fitted and this can be done in a predetermined and robust way. The reflector according to the invention can be used with numerous configurations of power supply circuit, heat sink or types of light source. By using the reflector according to the invention combined with other measures aimed at attenuating the aforementioned electromagnetic disturbances, the resulting shielding system becomes particularly powerful.

Further features and advantages of the present invention will become better understood with the aid of the description of some exemplary and nonlimiting embodiments and from the drawings among which:

In what follows, the technical features described for one precise embodiment may be combined with features from other embodiments without thereby departing from the scope of the invention, unless indicated to the contrary or unless the elements described for various embodiments describe alternative solutions.

Figure 1:
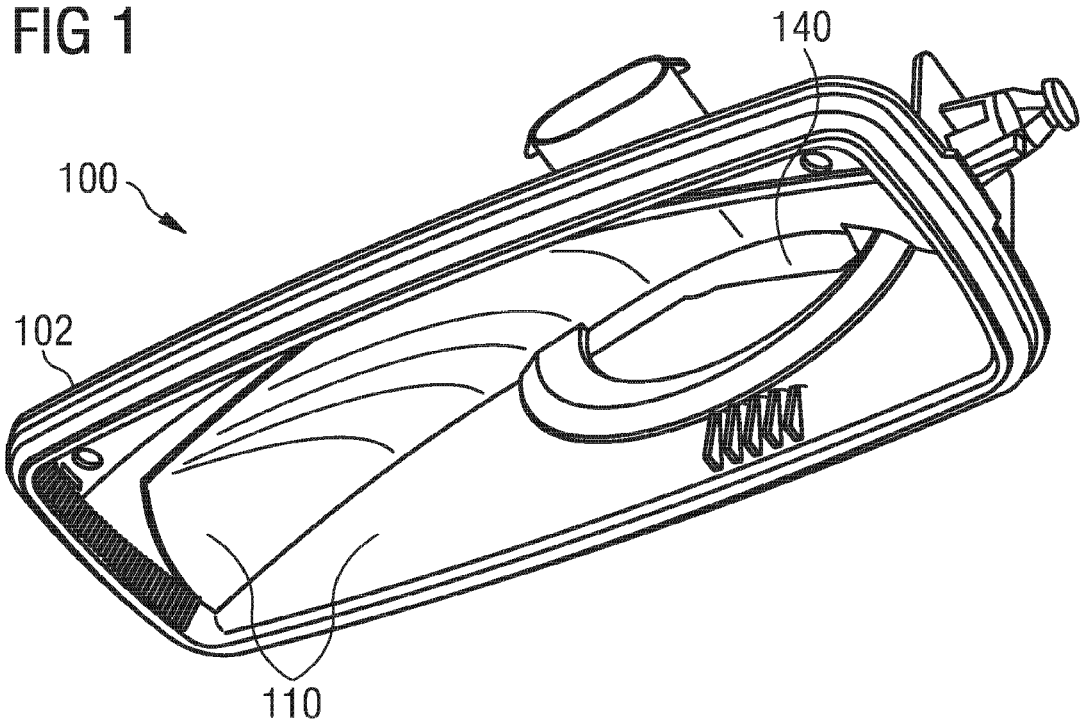
FIG. 1 is a perspective view of a device according to one embodiment of the invention, the view showing the internal faces of the housing.

A reflector device 100 according to one embodiment is shown in the illustration of FIG. 1. It comprises a housing 102 made of plastic. The housing is, in the known way, formed by molding a synthetic substance or by thermoforming, depending on the material used. The internal faces 110 of such a housing are metallized and formed in such a way as to reflect the light incident thereon in directions that are predefined and that are dependent on the intended use of the lighting module of which the reflector may form part. The reflected light can then be directed by a light guide, not illustrated, coupled to the open face of the housing. An opening 140 places the inside of the housing in communication with its rear face.

Figure 2:
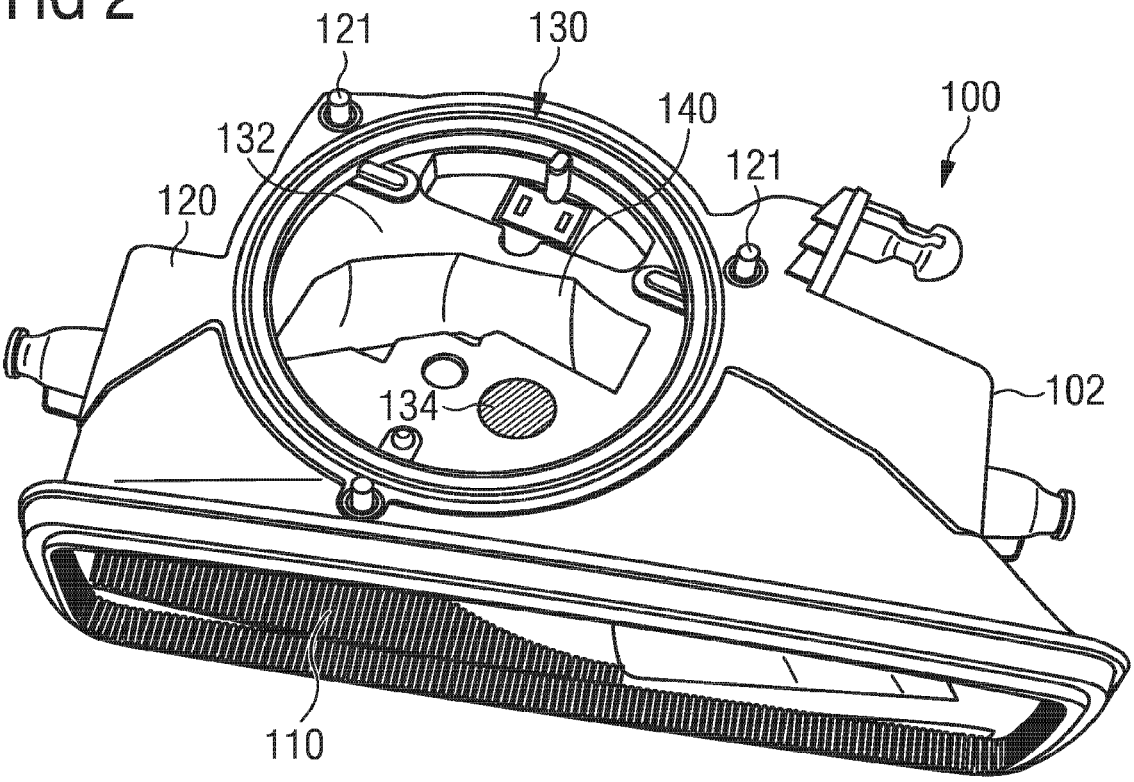
FIG. 2 is a perspective view of the housing of FIG. 1, the view however showing the external faces of the housing and the reception means provided thereon.

This rear face is shown in the illustration of FIG. 2. The external face 120 of one of the walls of the housing 102 comprises reception means 130 capable of housing a lighting device. This may for example be a support, such as a printed circuit, comprising light emitting diodes LEDs. Indexing studs 121 are provided to align the lighting device with respect to the housing so that the LEDs are oriented in such a way that their emitted light can propagate through the opening 140 toward the inside of the housing, where it is reflected.

In one embodiment, an LED power supply circuit is provided on the printed circuit that comprises the LEDs. Such a circuit is known in the art and its operation will not be described in detail in the context of the present invention. The circuit advantageously comprises a converter that allows an input voltage supplied by a battery of a vehicle to be converted into a charge voltage capable of powering the LEDs. For preference, the power supply circuit is provided on the opposite face of the printed circuit board so as to reduce the electromagnetic disturbances it produces in the direction of emission of light.

In the preferred embodiment of the housing 100 which is shown in FIG. 2, reception means 130 comprise a cavity fashioned in the external face 120 of the housing. The cavity shown is circular in shape. A person skilled in the art will know how to adapt the geometry (shape, depth) of the cavity to suit the support and power supply circuit that may be housed therein. The bottom of the cavity comprises the opening 140 that allows the emitted light to enter the interior of the reflector. Electromagnetic waves may also be propagated through this opening. The reception means may, in other embodiments, be formed by means that allow an LED support to be attached to the face 120 without otherwise entailing the presence of the cavity.

In order to use the housing as an element providing shielding against electromagnetic waves radiated by the power supply circuit and/or the light sources, a contact zone 134 allowing the rear of the housing to be connected to ground is provided on the rear face 120 and notably at the level of the reception means 130. This is a metallized zone for example using aluminum metallized using metallization methods known per se. The zone 134 is illustrated as being a generally circular portion of the bottom of the cavity of the reception means. Alternatively, the zone 134 may cover the entire bottom of the cavity or even the entirety of the face 120 of the housing.

The use of the housing according to the invention in a lighting module for the lighting and/or signaling of a motor vehicle means that the contact zone 134 can be connected by direct contact to the ground potential present on the printed circuit which is housed by the reception means 130. Electrically connecting the contact zone may also be done using an electrically conducting spring one end of which is soldered to the printed circuit housed in the reception means 130 and connected to the ground potential. The spring is sufficiently long, and its location chosen in such a way that its free end comes into contact with the contact zone 134 when the printed circuit is mounted and fixed on the housing 102. Alternatively, the spring is soldered to the contact zone 134 of the housing, and its free end comes into contact with a zone connected to ground on the printed circuit during mounting.

According to a different embodiment, the zone 134 is electrically connected to a heat sink that allows removal of the heat produced by the light sources and/or the power supply circuit when they are in operation. A heat sink is connected to the ground potential.

That which follows will describe one particularly preferred embodiment in which the specific arrangements of the housing 102 collaborate with other means of attenuating electromagnetic disturbances in order to create a synergistic shielding effect.

Figure 3:
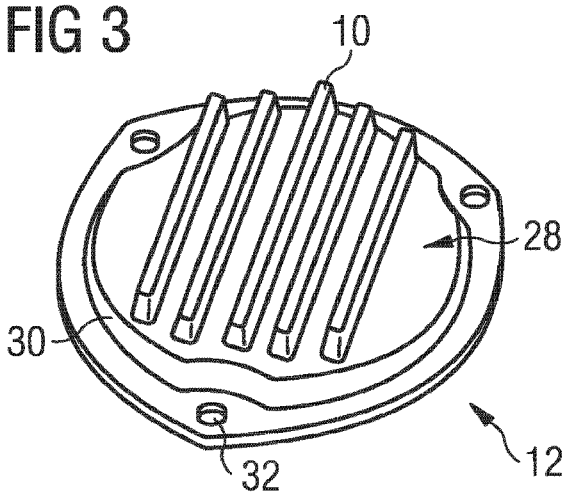
FIG. 3 is a perspective view of the upper face of a cover able to collaborate with the reception means of a reflector according to one embodiment of the invention.

Heat exchange means such as a heat sink are formed on an external face of a cover 12 illustrated in FIG. 3, arranged in the reception means 130 formed in the wall that covers the casing or housing 102.

The cover is illustrated in a view from above in FIG. 3, which means to say with the external face 28 that bears the heat exchange ribs visible. The cover on this external face has a central additional thickness 30 able to allow the opposite internal face 31 to have a sizeable cavity made in it to house the printed circuit board. The cover further comprises bores 32 for fixing to the housing 102, so as to allow the cover to be fixed to the housing using screw means which have not been depicted.

The embodiment, illustrated in FIGS. 4 to 7, in which a printed circuit board 33 is attached to the internal face 31 of the cover which is visible in these figures, with an attached element which closes an opening left between the plate and the cover.

The printed circuit board 33 consists of a plate to which the light emitting diode or diodes and electronic components for controlling the operation of the diode, according to control instructions received by a module associated with the diode, are soldered. When the printed circuit board 33 is attached to the internal face 31 of the cover it will be appreciated that the diode is soldered on the external face of the board, opposite to the cover 12, so as to be able to emit rays of light toward the opening 140 made in the housing, while the electronic components are soldered to the internal face of the board, facing toward the cover 12.

The printed circuit board 33 comprises on the face that houses the light sources at least one region 34 representing ground potential, which is able to come into contact with the contact zone 134 of the housing when the lighting module is assembled as described.

The electronic components are soldered to the plate and these components may advantageously be laid out on the plate according to their potential for generating electromagnetic waves. Thus, the major contributors of electromagnetic disturbances, such as, for example, a DC/DC voltage converter, may be positioned in a precise zone of the plate so as to be sure that they are located inside the wave confinement cage as will be described hereinafter. Electronic components that create little or no electromagnetic disturbances may themselves be positioned anywhere on the plate.

The plate on its periphery has notches 36 able to collaborate with the indexing studs 121 formed on the housing 102, and at its center it has bores 38 able to collaborate with indexing posts formed this time on the internal face of the cover, as will be described hereinafter. The plate also comprises slots 40 formed uniformly near a front longitudinal edge 42 of the printed circuit board and able to collaborate with tabs borne by the attached element 80. In this instance, four of these slots are provided.

In the example illustrated, the plate at each longitudinal end has rounded edges 44 and, from one longitudinal end to the other, two parallel lateral edges 46 delimited longitudinally by transverse edges which prolong these lateral edges perpendicularly toward the outside of the plate.

Figure 5:
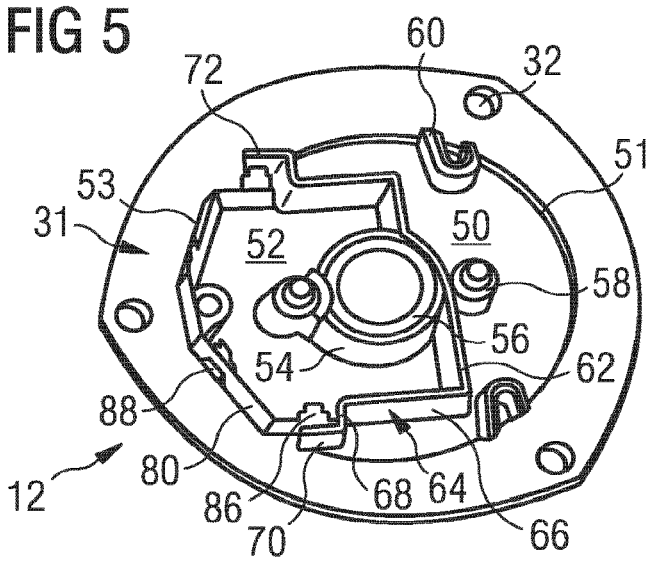
FIG. 5 is a perspective view of the underside face of the cover of FIG. 3, without the printed circuit and the attached component.
Figure 6:
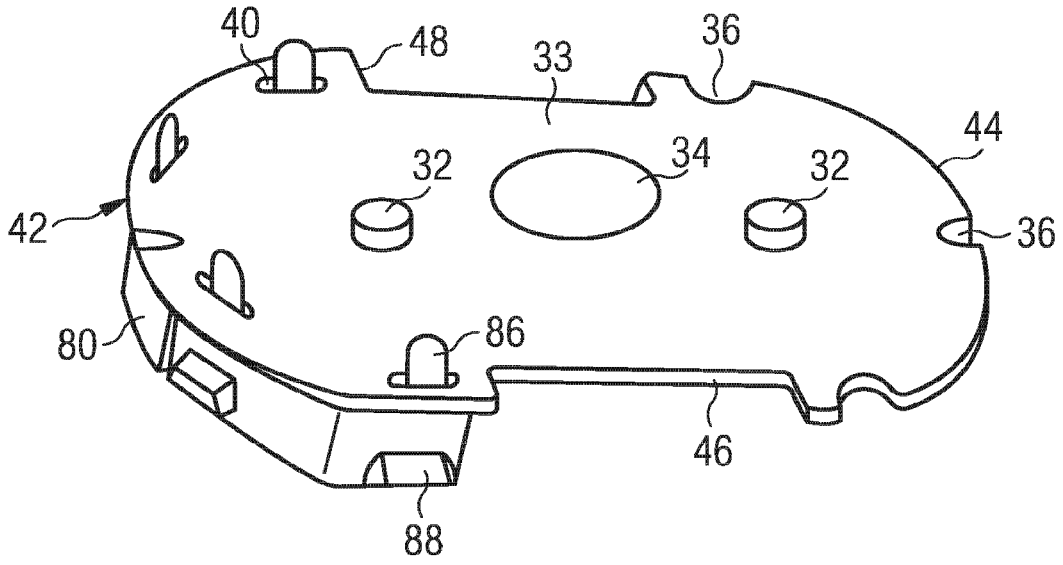
FIG. 6 is a perspective view showing only the printed circuit and the attached component of FIG. 4.

As is particularly visible in FIG. 5, the internal face 31 of the cover is made into a cavity to form a housing space and has projecting elements able to form a cage for the confinement of the electromagnetic waves generated by the electronic components.

The cavity of the internal face comprises two zones separated substantially transversely by confinement walls. A first zone 50 is delimited by these walls and by a circular rim 51 and a second zone, forming the confinement zone 52, is delimited by these walls and by a rim 53 formed by straight-line segments.

The internal face 31 of the cover comprises, inside these walls delimiting the housing space, a central barrel 54 with a channel 56 on the periphery to prevent thermal paste from overspilling when the printed circuit board is being mounted on the cover. Specifically, a thermal paste is placed on the top of the barrel liable to be in contact with the printed circuit board upon mounting, to facilitate the transmission of the heat emitted by the diode to the cover and its means of thermal cooling.

The internal face 31 of the cover also bears two indexing posts 58 arranged longitudinally on each side of the central barrel 54, and indexing means 60 that complement those formed on the housing to grip the printed circuit board 33.

As was described previously, the internal face of the cover has walls extending as a projection from the bottom wall of the housing space to delimit the first zone 50 and the confinement zone 52. A first transverse wall 62 extends substantially across the housing space. Its free end opposite to the cover has a flat surface to act as a support for the printed circuit board. The transverse wall is extended at right angles by lateral walls 64 which respectively connect to one of the lateral ends of the transverse wall. These lateral walls have a main part 66 which extends longitudinally in the continuation of the transverse wall, and a chicane formed by an intermediate wall 68 which extends transversely to the main part and by an end wall 70 substantially parallel to the main part.

As can be seen in FIG. 5, in which the printed circuit board has not been depicted, the lateral walls 64, unlike the transverse wall 62, do not have a flat surface at their free end but a low wall 72 arranged on the side opposite to the confinement zone and which forms an end stop for the fitting of the printed circuit board on the lateral walls.

Figure 4:
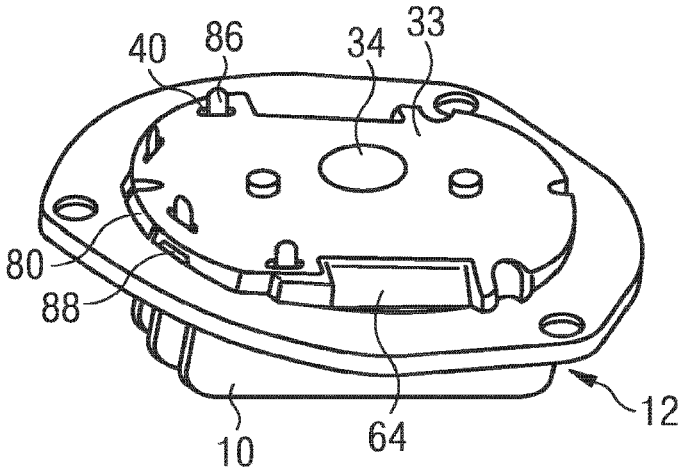
FIG. 4 is a perspective view of the underside face of the cover of FIG. 3, showing a printed circuit able to collaborate with the contact zone of a reflector according to one embodiment of the invention, and also showing an attached component.

Thus, when the printed circuit board is in place on the cover, as illustrated in FIG. 4, the board rests on the planar face of the transverse wall so that it extends on each side of this transverse wall, whereas it rests on the lateral walls with the low walls which surround it.

The lateral walls 64 are truncated at the end of the chicane so that they do not meet one another, and so that an opening 74 is thus left at one front longitudinal end of the confinement zone, between the lateral walls, at the level of the rim 53 formed by the straight-line segments. A front and rear longitudinal end is defined here according to the installation in the vehicle. As will be explained hereinafter, the orientation chosen here is of particular benefit in that the opening is arranged on the opposite side to the vehicle interior, so that any escaping electromagnetic waves will be without impact. However, it will be appreciated that the orientation overall could change without departing from the context of the invention.

The bottom wall of the housing space is a planar surface, in one of the zones delimited by the edges and the confinement walls just as in the other. It may be seen in FIG. 5 that there is an additional wall 76 projecting from the bottom wall, facing the rim 53 formed by the straight-line segments. The additional wall 76 has a height lower than that of the rim 53 and it too is formed of straight-line segments so that it extends parallel to this edge. This then forms a channel 78 between the rim of the housing space and the additional wall, in which channel the attached element 80 is intended to fit.

FIG. 5 shows that the additional wall and the associated channel extend from the base of the chicane formed by the lateral confinement walls 64, thereby creating a zone of overlap between the channel and the walls.

As is the case in the embodiment illustrated, the depth of the confinement cage formed in the housing space on one side of the confinement walls may be greater than that of the housing space on the other side of the confinement walls. Thus, bulkier electronic components can be housed.

As has just been described, the cage 52 for the confinement of electromagnetic waves which is produced in the lighting module according to the invention is specific in that it has an opening 74 in a first axial direction. FIGS. 4 to 7 depict a mode of use in which an attached element 80, arranged between the cover 12 and the printed circuit board 33, acts as a closure piece able to block off this opening.

As an alternative, the axial opening is not plugged by an attached element or alternatively the attached component is replaced by a wall formed as one with the cavity of the cover. According to one embodiment of the invention, the attached element that acts as a closure piece is made from a metallic material. That makes it possible to enhance the attenuation of the electromagnetic disturbances generated by said at least one electronic component.

Figure 7:
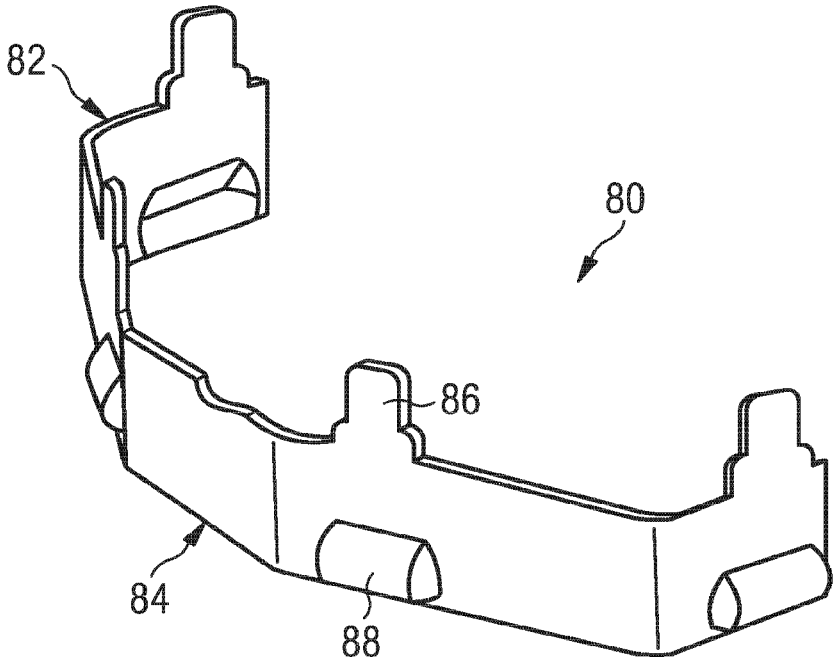
FIG. 7 is a perspective view showing only the attached component of FIG. 4.

In the first embodiment, the attached element takes the form of a piece of bent sheet metal 80 visible notably in FIG. 7. The piece is bent so that it has a form made up of successive straight-line portions, complementing that of the channel 78 formed at the axial end of the confinement zone 52. Over the length of the component, a first edge 82 bears fixing means and a second edge 84 is straight. Here, the attached element is secured to the plate.

The fixing means takes the form of tabs 86, each tab extending from the first edge 82 in the plane of the straight portion of the piece that it extends.

The piece of bent sheet metal also comprises bosses 88 projecting from the plane of the piece, in the vicinity of the straight second edge 84. The purpose of these bosses is to ground the piece of bent sheet metal, with the intended purpose of stopping the electromagnetic waves generated in the confinement zone, on the cover.

The piece of sheet metal is advantageously made from stainless steel, of benefit here in that the piece has good elasticity at the bosses in order to facilitate contact between the piece and the cover in the region of the channel, and so that there is no oxidation of the sheet metal piece. The height of the attached element, acting as a closure piece, namely the distance between the first edge bearing the fixing means and the flat second edge, is slightly smaller than the distance between the support plane of the printed circuit board and the bottom of the housing space at the level of the channel. In that way, a passage for air is left between the bottom of the housing space and the attached element that acts as a piece that closes the opening of the confinement zone.

The invention claimed is:

1. A reflector device for a lighting module of a motor vehicle, the device comprising:

a housing made of plastic having internal faces, at least part of the internal faces of the housing being metallized to reflect light received, the housing comprising, on an external face of one of its walls, a receiver to house a support comprising at least one light source, said one of its walls comprising an opening which leads to an inside of the housing and which allows light emitted by the at least one light source to propagate toward the inside of the housing, the opening surrounded by a rim and to which the support comprising the at least one light source is attached being perpendicular to an exit opening in the housing through which the light emitted by the at least one light source exits the reflector device, wherein at least part of the receiver on the external face of the housing is metallized to define a contact zone that allows the metallized part to make electrical contact, the receiver includes indexing studs to align the support comprising the at least one light source relative to the housing in order to orient the at least one light source in a direction that allows the light emitted by the at least one light source to propagate through the exit opening, and the indexing studs are arranged on a surface of the housing opposite the rim and outside a circumference of the rim.

2. The device according to claim 1, wherein the receiver includes a cavity in the external face of the one of said walls of the housing, a bottom of the cavity comprising said opening.

3. The device according to claim 1, wherein external faces of the housing are metallized.

4. The device according to claim 1, wherein the metallization of the external face comprises a layer of aluminium.

5. A lighting module for lighting and/or signaling of a motor vehicle, comprising:

a reflector device, wherein the reflector device is according to claim 1, the receiver of the housing is configured to house said support to allow light emitted by at least one light source to propagate through said opening, and the contact zone being connected to ground.

6. The lighting module according to claim 5, wherein the support is a printed board, the at least one light source being arranged on a first face of the printed board which faces toward the external face of the wall of the housing of the reflector device.

7. The lighting module according to claim 6, wherein the printed board comprises on its second face at least one electronic component to control and power the at least one light source.

8. The lighting module according to claim 6, wherein the contact zone is electrically connected to an element of a control circuit, which is connected to ground.

9. The lighting module according to claim 5, wherein the module further comprises a heat sink to allow removal of heat produced by the at least one light source or by an electrical power control circuit.

10. The lighting module according to claim 9, wherein the at least one light source is arranged on the heat sink.

11. The lighting module according to claim 9, wherein the contact zone is electrically connected to the heat sink, which is connected to ground.

12. The lighting module according to claim 10, wherein the contact zone is electrically connected to the heat sink, which is connected to ground.

13. The lighting module according to claim 5, wherein the contact zone is electrically connected to an element of a control circuit, which is connected to ground.

14. The lighting module according to claim 5, wherein the at least one light source includes at least one light emitting diode (LED).

15. The device according to claim 2, wherein all of external faces of the housing are metallized.

16. The device according to claim 2, wherein the metallization of the external face comprises a layer of aluminum.

17. The device according to claim 3, wherein the metallization of the external face comprises a layer of aluminium.

18. A lighting module for the lighting and/or signaling of a motor vehicle, comprising:

a reflector device, wherein the reflector device is a device according to claim 2, the receiver of the housing being configured to house said support to allow light emitted by at least one light source to propagate through said exit opening, the contact zone being connected to ground, and the opening to which the support including the at least one light source is attached to the receiver is perpendicular to the exit opening in the lighting module through which the light emitted by the at least one light source exits the reflector.

* * * * *